US007574757B2

(12) United States Patent
Song

(10) Patent No.: US 7,574,757 B2
(45) Date of Patent: Aug. 18, 2009

(54) FOLDABLE FRAME STRUCTURE FOR A CHILDREN'S PLAY-YARD

(75) Inventor: Zhenghuan Song, Kunshan (CN)

(73) Assignee: Goodbaby Child Products Co., Ltd. (CN)

( * ) Notice: Subject to any disclaimer, the term of this patent is extended or adjusted under 35 U.S.C. 154(b) by 0 days.

(21) Appl. No.: 12/019,054

(22) Filed: Jan. 24, 2008

(65) Prior Publication Data

US 2008/0155747 A1 Jul. 3, 2008

Related U.S. Application Data

(63) Continuation of application No. 11/072,709, filed on Mar. 4, 2005, now Pat. No. 7,343,634.

(30) Foreign Application Priority Data

Aug. 20, 2004 (CN) ..... 2004 1 0041768

(51) Int. Cl.
*A47D 7/00* (2006.01)

(52) U.S. Cl. ..... 5/99.1; 5/93.1; 5/93.2

(58) Field of Classification Search ..... 5/99.1, 5/93.1, 98.1, 93.2
See application file for complete search history.

(56) References Cited

U.S. PATENT DOCUMENTS 5,279,006 A * 1/1994 Teng ..... 5/99.1
5,867,851 A * 2/1999 Mariol et al. ..... 5/99.1
D494,393 S * 8/2004 Chen ..... D6/503

* cited by examiner

*Primary Examiner*—Fredrick Conley
(74) *Attorney, Agent, or Firm*—Kam W. Li; Procopio, Cory, Hargreaves & Savitch

(57) ABSTRACT

A frame structure for a foldable children's play-yard adaptable to include a curved side rail to form at least a portion of its upper perimeter. The frame structure comprises a plurality of support members, an upper frame member and a lower frame member. The upper frame member is constructed of a plurality of side segments, which define the upper perimeter of the play-yard and comprise rail members, which can include a curve portion. The rail members are coupled in a rotatable relationship disposed between the adjacent support members. The side segments have opposite distal end portions in engagement with support brackets mounted on the support members, the support brackets are adaptable to affix the side segment when the play-yard is in the open configuration and to permit the side segments to move in more than a single degree of freedom (for example, translational, axial-rotational movement and swivel movements) when the play-yard is being folded. The base frame member comprises a base hub and a plurality of extension members hingedly coupled to the base hub and extending therefrom to engage the lower portions of the support members in a pivotal relationship.

17 Claims, 7 Drawing Sheets

FOLDABLE FRAME STRUCTURE FOR A CHILDREN'S PLAY-YARD

RELATED APPLICATION

The present application is a continuation of co-pending U.S. patent application Ser. No. 11/072,709 filed on Mar. 4, 2005, which claims foreign priority under Chinese Patent Application, No. 200410041768.X, filed Aug. 20, 2004 pending before the State Intellectual Property Office of China, and the contents of both of the aforementioned preceding applications are incorporated herein by reference in their entirety.

BACKGROUND

1. Field of the Invention

This invention relates to a children's play yard, and more particularly to a foldable children's play-yard frame structure, which may including curved peripheral sides.

2. Related Art

Various prior art foldable children's' play-yards are known. Two examples of such known prior art are disclosed in U.S. Pat. Nos. 4,811,437 and 5,446,936. These prior art play-yards generally incorporate a rectangular frame structure having a front side, a back side and two opposite lateral sides. The frame structure has four corner upright support legs to provide structural support for the play-yard. The support legs are connected to an upper frame member by L-shape corner connectors. These L-shape connectors have two perpendicular body segments each having vertically spaced apart internal walls to form downward-facing internal open channels. The L-shape corner connectors are rigidly mounted to the top of the support legs.

The upper frame member is constructed of four pair of elongated straight tubular side rails, which form the four sides of the rectangular frame and define the upper perimeter of the play-yard. On the front and the back sides of the rectangular frame, the two side rails are secured in the internal channels of the L-shape connectors of the adjacent support legs. The side rails are pivotally connected to the walls of the L-shape connectors to enable the side rails to rotate on a vertical plane that is defined by that side of the frame. The other ends of the side rails are pivotally connected to a rail connector to enable the side rails to rotate and folded into a V-shape configuration along the same vertical plane.

On the lateral sides of the play-yard, the side rails are similarly pivotally connected to the other perpendicular sides of the L-shape connectors and to the rail connectors to enable the side rails to be rotated on the vertical planes as defined by the respective lateral sides.

The frame structures of the prior art also have a lower frame member which is pivotally connected to the lower portions of the of the upright support legs and is foldable during retraction of the play-yard from an extended configuration to a folded configuration. The lower frame member incorporates a central hub pivotally connected to four radially extending straight tubular members that are pivotally connected to the lower portion of the upright legs.

In the prior art design, each rail connector has a releasable locking mechanism to secure the side rails in a straight line when the play-yard is fully deployed. When the lock is released, the play-yard can be retracted by rotating the side rails on the four rectangular sides on their respective vertical planes while the upright legs are drawn together. In the folded configuration, the side rails would generally assume a V-shape relationship tucked on the underside the L-shape connectors between the parallel upright legs.

While the prior art design provides for a foldable children's play-yard, there are a number of drawbacks. In general, the prior art design is limited to a rectangular structure where the square corners and straight lines of the structures often lack aesthetic appeal to those who would prefer a more streamlined structural configuration having curves and non-straight line designs. Furthermore, as disclosed in the afore-referenced United States patents, although the intended objective of the prior art design is to provide a foldable children's play-yard having the apparent capability of folding a rectangular frame structure into a compact configuration with a square end profile, the folding operation can be challenging in practice.

In the prior art frame structures, the footprint of the play-yard is defined by the support legs arranged in a spaced apart rectangular relationship when the play-yard is deployed. In the deployed configuration, the tubular members of the lower frame are oriented in pairs to bisect in a non-perpendicular relationship. When the play-yard is retracted, the support legs are collected side by side into a folded configuration having a square end profile. As the rectangular frame structure is folded, the individual lower frame tubular members would experience an internal stress. This is due to lateral displacements of the lower frame tubular members necessitated by the change of the rectangular footprint to the square footprint of the play-yard structure from the deployed to the folded configuration. Such internal stress is transmitted to the support legs and the corner connectors and other parts of the frame structure making the folding operation difficult or inconvenient.

SUMMARY OF THE INVENTION

The present invention provides a foldable play-yard frame structure, which may contain one or more curved side segments as part of the sides of the play-yard. The play-yard frame structure can be accessorized by a cloth cover mounted on it. The frame structure has a plurality of upright supports, an upper frame member and a lower frame member.

The upper frame member defines the upper periphery of the play-yard, which comprises a plurality of side segments. A side segment is formed of a pair of side rails, which can be constructed of a curve member to extend the play area outside the footprint of the play-yard as defined by the line connecting the upright supports.

The side segments are placed between adjacent upright supports and are connected to brackets rotatably secured to the upright supports. The connection is such that the side rails are secured in a laterally extending configuration when the play-yard is deployed. When the play-yard is being folded, the side rails can be maneuvered with more than one degree of freedom in such a way that the side segments, which might include a curve portions, can be substantially folded and stowed between adjacent pairs of upright members.

The side rails are each connected by a releasable locking means to secure the rails in a straight or curvilinear direction. When the locking means are released, the side rails are pivotable in relationship to each other.

The base frame member comprises a base hub, which is centrally located in the play-yard structure. The base frame member has a plurality of extension members, which are hingedly coupled to the base hub. The extension members extend from the base hub to engage the lower portions of the upright support members in a pivotal relationship and to affix the upright supports in a substantially vertical orientation.

The extension members are also hingedly coupled to the footing of the support members. When the play-yard is deployed, the upright supports are secured in a spaced apart relationship which defines the lower footprint of the play-yard. On retraction, the upright supports are drawn toward the central portion of the play-yard while the extension members are pivotally vertically.

These and other aspects will become apparent from the following detailed description, and the accompanying drawings, which illustrate by way of example the features of embodiments of the invention.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

One embodiment of the present invention provides a frame structure for a foldable children's play-yard, which is adaptable to include a curved side rail forming at least a portion of its upper perimeter. The frame structure is deployable in an open configuration and retractable into a folded compact configuration. The frame structure comprises a plurality of support members, an upper frame member and a lower frame member. These members provide structural support to the play-yard when it is deployed in the open configuration. On retraction, they cooperate with each other, including the curved side rail segment(s), to enable manipulation to fold the frame structure into a compact configuration. The play-yard can be provided with a cloth cover mounted onto the frame structure for the play area.

The upper frame member is constructed of a plurality of side segments, which define the upper perimeter of the play-yard and comprise rail members, which can include a curve portion. The rail members are coupled in a rotatable relationship disposed between the adjacent support members. The side segments have opposite distal end portions in engagement with support brackets mounted on the support members, the support brackets are adaptable to affix the side segment when the play-yard is in the open configuration and to permit the side segments to move in more than a single degree of freedom (for example, translational, axial-rotational movement and swivel movements) when the play-yard is being folded. The base frame member comprises a base hub, a plurality of extension members hingedly coupled to the base hub and extending therefrom to engage the lower portions of the support members in a pivotal relationship.

Figure 1:
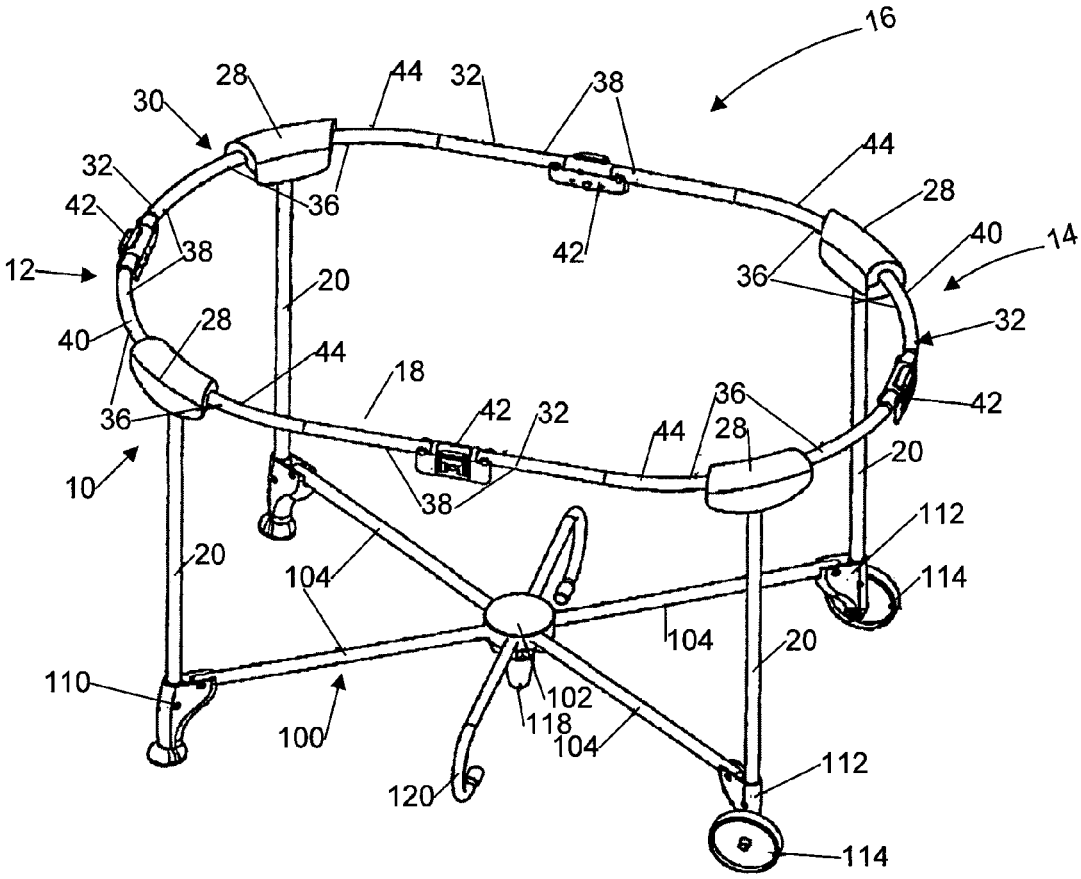
FIG. 1 is a perspective view of one embodiment of a children's play-yard frame structure in a deployed configuration.

As shown in FIGS. 1, 6, 7, 8, 9 and 12, one embodiment of a children's play-yard has a foldable frame structure 10 and a fabric cover 15. Frame structure 10 comprises a plurality of support members 20, which provide structural support to the play-yard. When the frame structure 10 is deployed in the open configuration as shown in FIG. 1, the support members 20 are erected upright in a substantially parallel, spaced apart and relationship. The footing of the support members defines the rectangular footprint of the play-yard.

The support members 20 are preferably of tubular construction. Each support member 20 has an elongated body, an upper portion 22 and a lower portion 24. A support bracket 28 is rotatably mounted to the upper portion 22 of each support member 20 such that it can rotate about the longitudinal axis, or the equivalent of the longitudinal axis, of the support member 20.

The frame structure 10 of the present invention also has an upper frame 30, which comprises a number of side segments 32 between the adjacent support members 20 and defines the upper perimeter of the play-yard when it is in the open configuration. Each side segment 32 has at least a pair of rotatably connected rail members 34. In the embodiment shown in FIGS. 1 and 2, the proximal portions 38 of the rail members 34 are each pivotably coupled to a rail connector 42.

Figure 3:
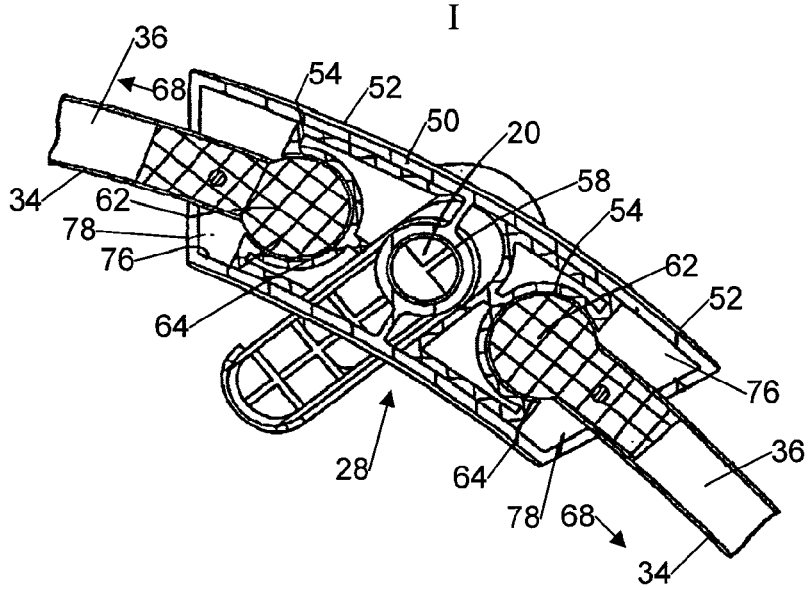
FIG. 3 is a partial cross-sectional view of the support bracket as shown in FIG. 2.
Figure 5:
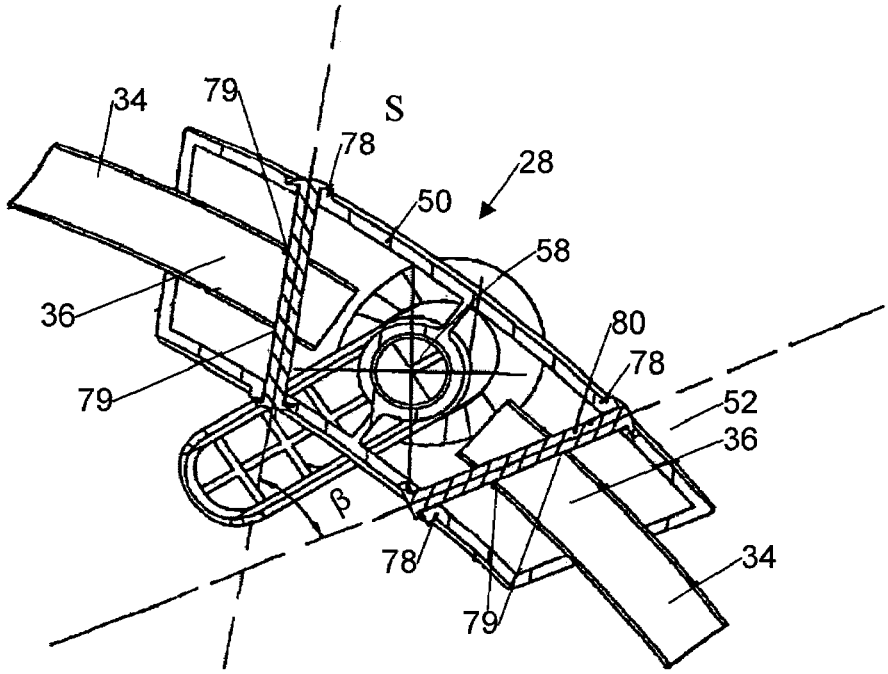
FIG. 5 is a partial cross-sectional view of the second version of the support bracket shown in FIG. 4.
Figure 6:
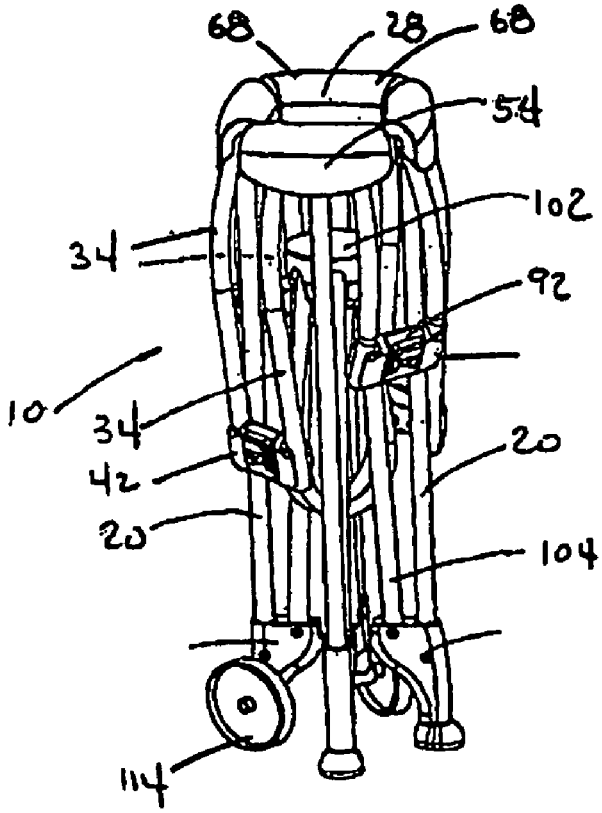
FIG. 6 is a perspective view of the children play-yard frame structure shown in a folded configuration.
Figure 7:
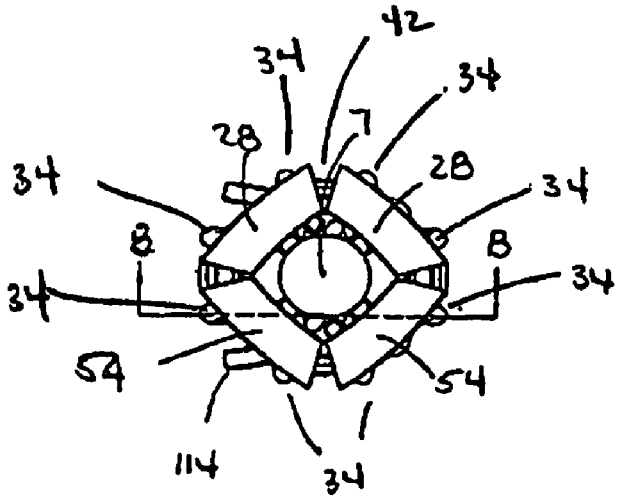
FIG. 7 is a top view of the children play-yard frame structure shown in a folded configuration.
Figure 9:
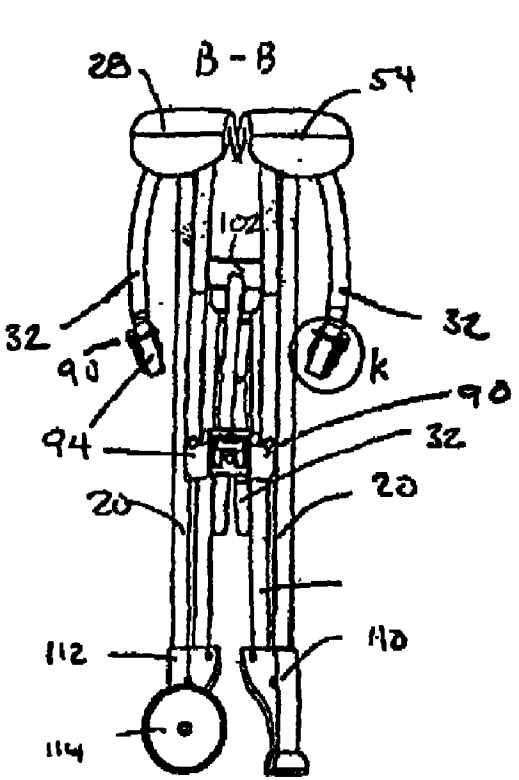
FIG. 9 is a side view taken from line B-B of FIG. 7.

At the opposite lateral sides of side segments 32, the side segments 32 are each secured to the support bracket 28 mounted on the support members 20. As shown in FIGS. 3 and 5, the distal end portions 36 of the rail members 34 are swivelably secured to the support bracket 28, which enable the distal end portions to move with more than pivotal motion on the vertical plane as would have been the case in the prior art. Thus, in the present invention, in addition to moving up and down along a vertical plane, the end portions can also be rotated side ways, as well as about the axis of the rail members. When the play-yard is being folded, the distal portions 36 of the side segments 32 are enabled to move with a multiple degree of freedom, wherein at least one of displacement or translational movement, axial rotational movement and swivel movement can be undertaken.

Figure 2:
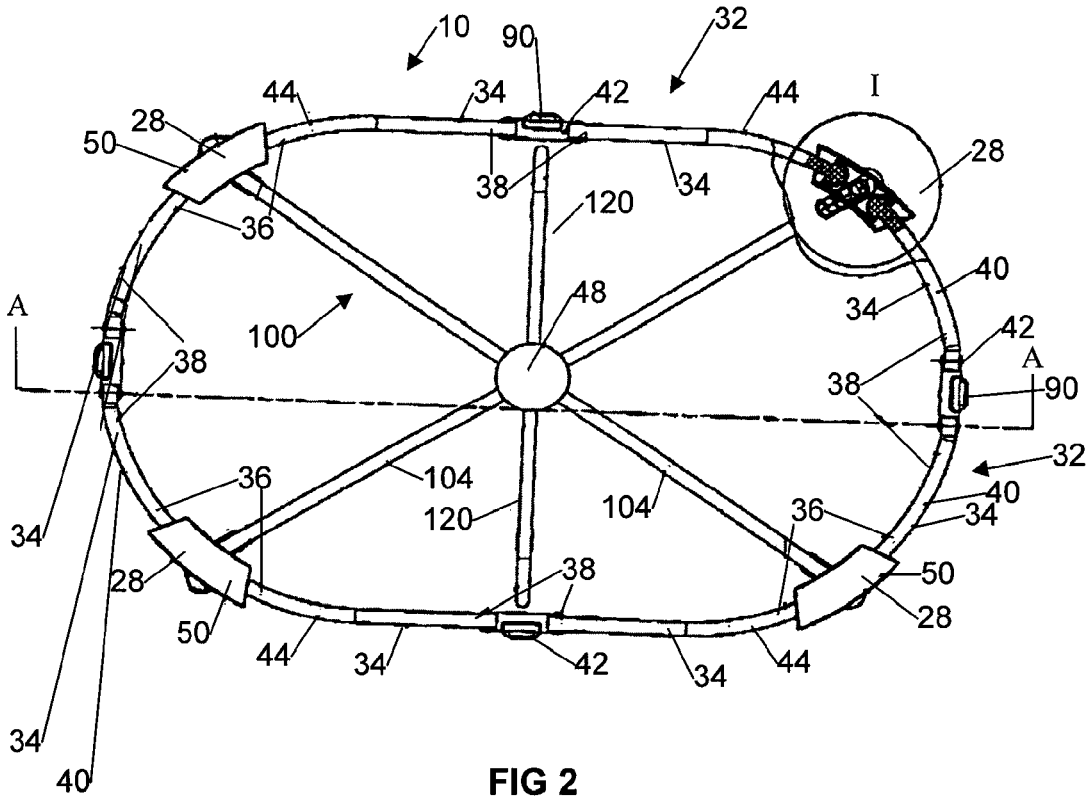
FIG. 2 is a top view of the play-yard frame structure, which contains one version of a support bracket incorporating a ball and socket joint.
Figure 4:
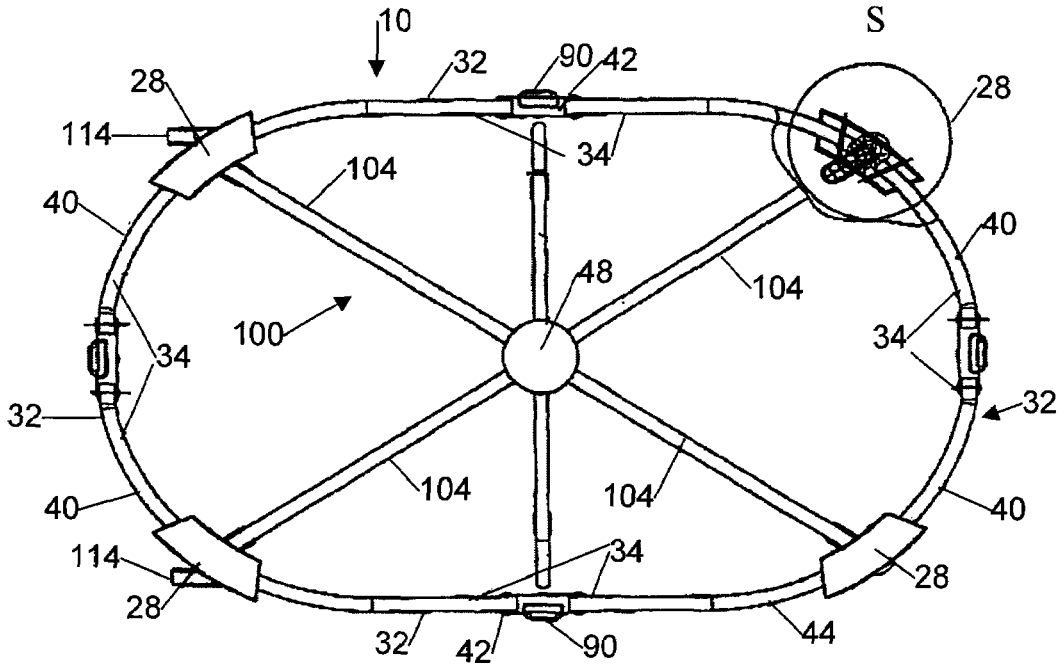
FIG. 4 is a top view of the play-yard frame structure, which contains a second version of a support bracket incorporating a pivot pin design coupling the side rails and the support bracket.

The upper frame 30 may contain one or more curve side segments, having at least a rail member in which a portion is formed of an arcuate section. FIGS. 1, 2 and 4 illustrate an embodiment in which two curve side segments 30 are provided on the opposite ends, the front side 12 and the back side 14, of the play-yard frame. Each of the curve side segments 30 further contains two connected curve sections 40. On the lateral sides 16 and 18 of the play-yard frame, the side segments 32 includes substantially straight rail members, each incorporating relative shorter arcuate sections 44. Alternative, the curve side segments can be separated by straight side segments (not shown).

As shown in FIGS. 1, 2 and 4, the side segments 32, which include both curve and straight sections, are arranged in a horizontal, coplanar fashion to define modified elliptical shape forming the upper periphery of the play-yard when deployed in an open configuration.

As an alternative embodiment, the upper frame 30 may incorporate one or more curve side segments oriented in non-coplanar relationship with the other side segments. As an example, a curved side segment 30 of the front side 12 of the frame structure 10 can be oriented on a plane that is tilted from the horizontal plane to define an upraised front one. In another example, the two curved side segments 30 on the opposite front and back sides of the play-yard can each be tilted from the horizontal plane thus providing an upraised front and a back sides for the play-yard. One or more of these curved side segments can be oriented vertically, that is perpendicular to the horizontal plane.

As referenced above, each of the support brackets 28 is rotatably secured to the upper portion 22 of a support member 20 such that it can rotate about the longitudinal axis or the equivalent thereof of the support member 20, as shown in FIGS. 2, 3, 4, and 5. Each support bracket 28 is formed of a housing 50 having a smooth exterior surface 52. Each bracket housing 50 is curved as appropriate to follow the general periphery of the upper frame 30 and is adaptable to conform to the palm of a gripping hand to facilitate the deployment and the folding of the play-yard. The support bracket 28 has folded spaced-apart wall portions 54 with a downward facing fold opening 56. The wall portions 54 form an internal receptacle 58 for receiving and retaining the upper portion 22 of the support member 20, such that the bracket 28 is allowed to rotate about the longitudinal axis of the support member. On the lateral sides of receptacle 58, the wall portions 54 further provide a means to receive and securely seat the side segments 32, which extend laterally of the support bracket 28, when the play-yard is deployed and to enable the side segments to be manipulated to fold into a compact configuration upon retraction of the play-yard.

As shown in FIG. 3, the wall portions 54 of the support bracket 28 and the distal end portions 36 of the rail members 34 form a ball and socket arrangement 60 interiorly to the bracket fold opening 56. Such arrangement enables the distal end portions 36 and the rail members 34 to swivel and move with more than pivotal motion on the vertical plane. Thus, in addition to pivoting motion on a vertical plane, the end portions can be rotated side ways, as well as about the axis of the rail members. When the play-yard is being folded, the distal portions 36 of the side segments 32 are enabled to move with a multiple degree of freedom to affect at least one of the rotational movement and swivel movement.

At the upper lateral sides 68 of the support bracket 28, the fold openings 56 are spaced apart to snuggly fit the exterior contour or dimensions of the distal end portions 36 of the rail members 34. Away from the upper lateral sides 68 of the support bracket 28, the fold openings 56 are widened. Accordingly, when the rail members 34 are extended in the deployment of the play-yard, the distal end portions 36 can be securely rested within the space provided at the upper lateral sides 68 of the bracket 28. When the play-yard is retracted, the rail members 34 can be manipulated to rotate from the laterally extending secured configuration to a downward orientation. Because the curve end portions 36 are permitted to swivel side ways, as well as to rotate about the axis of the rail members, the curve rail members, as they are being folded, can also be swung laterally relative to the pivot connection and to be stowed compactly between the adjacent support members. In comparison, while the prior art foldable play-yard enables the folding of the side rails with straight elongated sections, the limitation in the direction of movement of the side rails on the vertical plane would prevent the retraction of the side segments into a compact configuration.

FIG. 5 shows an alternative embodiment, wherein the wall portions 54 of the support bracket 28 and the distal end portions 36 of the side segments each has openings 78 and 79, which are in substantial alignment. An elongated fastener 80 passes through the openings 78 and 79, which secures the distal end portions 36 of the side segments 34 to the support bracket 28. The openings 78 of the wall portions 54 are slightly larger in size than the diameter of the elongated fastener 80, which is permitted to move with multi-degrees of freedom when the play-yard is being folded. These movements may include displacement or translational movement, axial rotational movement and swivel movement of the distal portions. Also, the wall openings 78 can be of elliptical or kidney-like shape. In the embodiment as shown in FIG. 5, the elongated fasteners securing the pair of side segments 32 onto the connector 28 form an angle $\beta$ of between approximately 30° to 75°.

As shown in FIGS. 1, 2, 3, 6, 9, 8, 10 and 11, the upper periphery of the play-yard is formed of a plurality pairs of side segments 32. Each side segment 32 is formed of a pair of rail members 34, which are hingedly coupled by pin 96 to permit pivotal movement for folding when the play-yard is retracted. A releasable locking means 90 is also provided for interconnecting the rail members 34 in secured, extended configuration while the play-yard is deployed. The locking means is released upon the retraction of the play-yard to enable folding of the rail members.

Designs of releasable locking means are known. In this embodiment, such a locking means comprises a rail connector 94 (FIGS. 10 and 11) having spring-loaded pins (not shown) which are inserted into openings of the proximal portions of the side rails to affixed the rail members in the laterally extending configuration. When the spring-loaded pins are released from the openings, the proximal portions of the side rails are disengaged by the pin and are allowed to rotate in a pivotal relationship to form a generally upright V-shape configuration. As the V-shape configuration of the side segment is being developed, the other end portions of the side segments also rotate from the laterally extending orientation to a downwardly extending orientation while the adjacent support members 20 are drawn toward each other. Accordingly, the adjacent support members are collected into a compact configuration with a generally square end profile.

Figure 8:
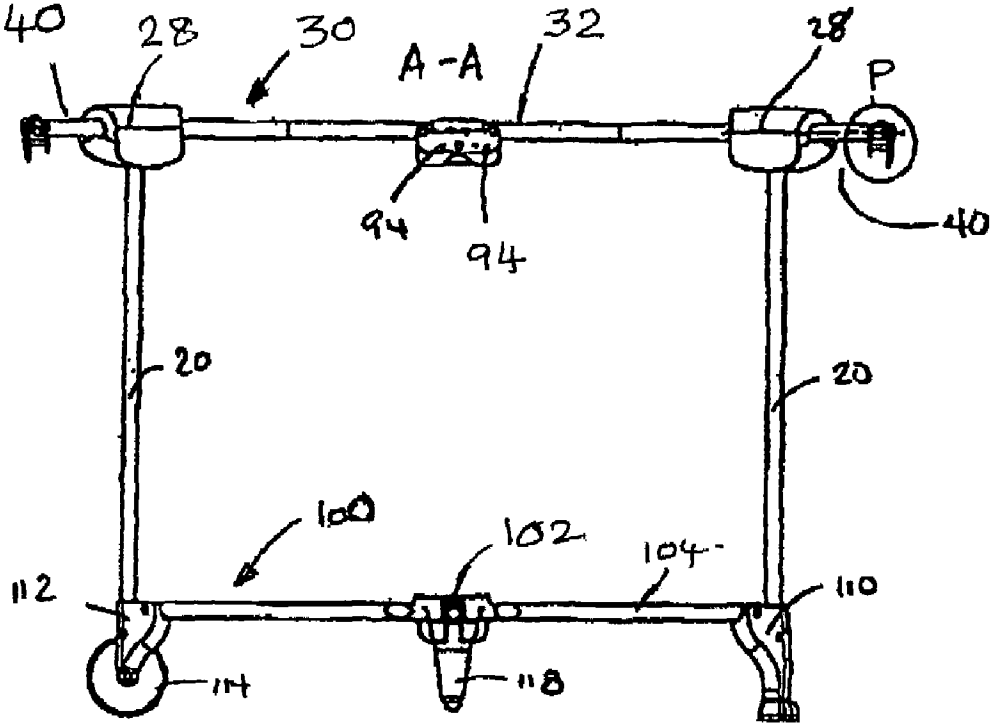
FIG. 8 is a partial cross sectional view taken from line A-A of FIG. 2.
Figure 10:
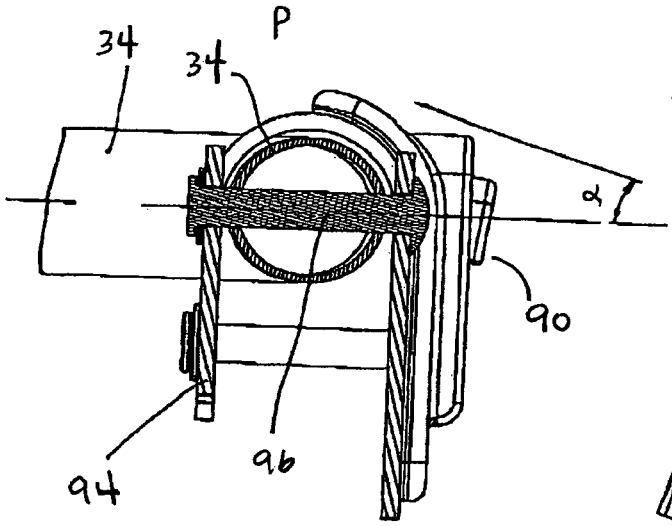
FIG. 10 is a partial cross-sectional view of the side rail connector shown in region P on FIG. 8.
Figure 11:
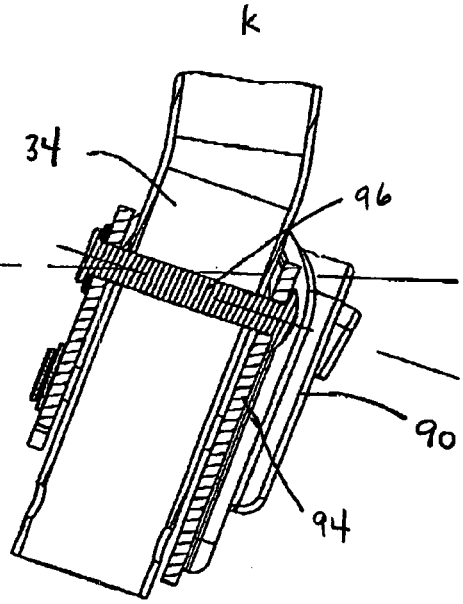
FIG. 11 is a partial cross-sectional view of the side rail connector shown in region K on FIG. 9.
Figure 12:
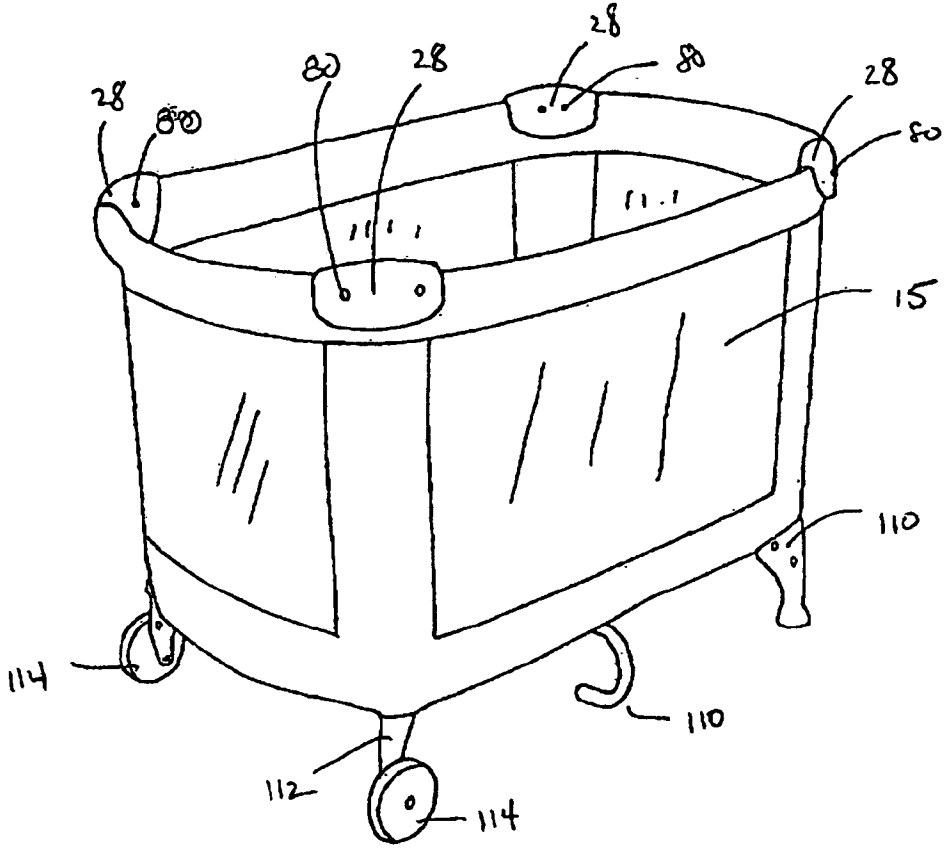
FIG. 12 is a perspective view of the play-yard in a deployed configuration with a fabric cover over the frame.

As shown in FIGS. 8 and 11 and as discussed above, the connections between the side rail members 34 and the support brackets 28 enable the manipulation of the rail members with multi-degree freedom of movement when frame structure 10 is retracted from its deployed configuration to its folded configuration. When the upright supports 20 are drawn toward the folded configuration, the rail members are also rotated by an angle $\alpha$ as illustrated to effect the displacement of the rail members to be folded and stowed between the adjacent upright supports.

In one embodiment, the stability of lower portion of the play-yard is provided by a base frame 100. The base frame comprises a base hub 102, which is centrally located in play-yard structure. The base frame also has a plurality of extension members 104, which are hingedly coupled to the base hub 102. The extension members 104 extend from the base hub 102 to engage the lower portions 24 of the support members 20 in a pivotal relationship and to affix the support members in a substantially vertical orientation.

As shown in FIGS. 1, 2, 4, 6, 8 and 9, the extension members are hingedly coupled to the support footings 110 and 112 of the support members 20. When the play-yard is deployed, the support members are secured in a spaced apart relationship, which define the lower footprint of the play-yard with a rectangular boundary. On retraction, the support members are drawn toward the central portion of the play-yard while the extension members 104 are pivotally vertically.

The support footings can also be selectively provided with wheels. As shown in FIGS. 1, 6, 8 and 9, the wheels 114 are secured to the hinge connectors 116 to facilitate the opening and folding of the play-yard during placement for use or retraction for transportation.

To provide further base support to the play-yard, a cone shape footing 118 is formed as part of the base hub. Optionally a pair of legs 120 are pivotally connected to the base hub 102. In the deployed configuration, the legs 120 are lockable to extend laterally. In retraction, the legs 120 can be rotated vertically side by side, which can be used as a handle to facilitate the retraction of the play-yard from the deployed configuration.

The children's play-yard described above exhibits a wide range of foldability and ease of manipulation that is not present in the prior art. In the deployed configuration, the rail members 34, which can incorporate at least a curve portion, extend laterally from the support member while it is securely seated against the interior wall of the support bracket. On retraction, at least one of displacement movement, axial rotational movement and swivel movement of the distal portions of the side rails is enabled when the play-yard is being folded. In contrast to the children's play-yard of the prior art where the folding of the side rails is only permitted along a vertical plane, which makes the use of a curved rail design impractical, the foldable children's play-yard of the above embodiments allows the end portions of the rail members to be maneuvered with multiple degrees of freedom. With the ability of the top bracket to rotate, the rail members can be easily folded and stowed between the adjacent support members in a compact configuration while reducing the torsional stress in the support members.

After reading this description it will become apparent to one skilled in the art how to implement the invention in various alternative embodiments and alternative applications. However, although various embodiments of the present invention will be described herein, it is understood that these embodiments are presented by way of example only, and not limitation. As such, this detailed description of various alternative embodiments should not be construed to limit the scope or breadth of the present invention as set forth in the appended claims.

What is claimed is:

1. A foldable children's play-yard frame structure deployable in an open configuration and retractable in a folded configuration, the play-yard comprising:

a plurality of support members, each having a lower portion, an upper portion and a support bracket associated with the upper portion;

an upper frame member, comprising a plurality of side segments defining the upper perimeter of the play-yard, each side segment comprising at least a pair of rail members coupled in a rotatable relationship and disposed between the adjacent support members, each side segment further having opposite distal end portions movable between an engaged position in engagement with the support brackets of the adjacent support members to affix the side segment when the play-yard is in the open configuration and a released position when the play-yard is being folded;

a rotational coupling between each side segment distal end portion and the respective support member which permits rotation of each side segment about at least two perpendicular axes of rotation when the distal end portion is in the released position and the play-yard is being folded; and a base frame member, comprising a base hub and a plurality of extension members hingedly coupled to the base hub and extending therefrom to engage the lower portions of the support members in a pivotal relationship.

2. The frame structure according to claim 1, wherein the side segments are arranged substantially in a co-planar relationship when the play-yard is deployed in the open configuration.

3. The frame structure according to claim 1, wherein the rail members of the plurality of pairs of the rail members are hingedly inter-connected to permit pivotal movement into a generally V-shape configuration when the play-yard is retracted.

4. The frame structure according to claim 3, which further comprises releasable locking means inter-connecting the rail members.

5. The frame structure according to claim 4, wherein the releasable locking means comprise a housing having folded walls rotatably securing an end portion of the rail members.

6. The frame structure according to claim 1, wherein the base frame member further comprises hinge connectors hingedly coupling the extension members to the lower portions of the support members.

7. The frame structure according to claim 6, further comprising at least a pair of wheels secured to the lower portion of the upright support members.

8. The frame structure according to claim 6, wherein the wheels are secured to the hinge connectors.

9. The frame structure according to claim 1, wherein the base hub further comprises a plurality of legs rotatably connected on the lateral sides thereto forming handle for retracting the frame and for supporting the base member when the frame structure is in the open configuration.

10. The frame structure according to claim 1, wherein the folded side rail members are stowed between the adjacent upright support members when the frame structure is in the folded configuration.

11. A foldable children's play-yard frame structure deployable in an open configuration and retractable in a folded configuration, the play-yard comprising:

a plurality of generally upright support members, each having a lower portion, an upper portion and a support bracket associated with the upper portion;

an upper frame member, comprising a plurality of side segments defining the upper perimeter of the play-yard, each side segment comprising at least a pair of rail members coupled in a rotatable relationship and disposed between the adjacent support members, each side segment further having opposite distal end portions movable between an engaged position in engagement with the support brackets of the adjacent support members to affix the side segment when the play-yard is in the open configuration and a released position when the play-yard is being folded;

a rotational coupling between each side segment distal end portion and the respective support member comprising a universal joint which permits rotational movement of the side segment about three perpendicular axes of rotation when the distal end portion is in the released position and the play-yard is being folded, each rotational coupling comprising a ball and socket joint; and a base frame member, comprising a base hub and a plurality of extension members hingedly coupled to the base hub and extending therefrom to engage the lower portions of the support members in a pivotal relationship.

12. A foldable children's play-yard frame structure deployable in an open configuration and retractable in a folded configuration, the play-yard comprising:

a plurality of support members, each having a lower portion and an upper portion;

a plurality of support brackets, each support bracket rotatably engaged with the upper portion of a respective support member;

an upper frame member, comprising a plurality of side segments defining the upper perimeter of the play-yard, each side segment comprising at least a pair of rail members coupled in a rotatable relationship and disposed between the upper end portions of a respective pair of adjacent support members, each side segment further having opposite distal end portions movable between an engaged position in engagement with the support brackets at the upper end portions of the adjacent support members to affix the side segment when the play-yard is in the open configuration and a released position when the play-yard is being folded;

a rotational coupling between each side segment distal end portion and the respective support bracket which permits rotational movement of the side segment with more than one degree of freedom when the distal end portion is in the released position and the play-yard is being folded;

a base frame member, comprising a base hub and a plurality of extension members hingedly coupled to the base hub and extending therefrom to engage the lower portions of the support members in a pivotal relationship; and at least one support bracket comprising a housing having folded, spaced apart wall portions between which the upper end portion of a respective support member and adjacent end distal end portions of respective side segments are engaged, the housing having a first pivot receptacle between the wall portions which receives the upper end of the respective support member for rotation about the longitudinal axis of the support member, a first rotational coupling between the wall portions on one side of the pivot receptacle and the distal end portion of a first side segment which allows rotational movement of the first side segment relative to the support bracket with more than one degree of freedom when the distal end portion is in the released position, and a second rotational coupling between the wall portions on the other side of the pivot receptacle and the distal end portion of a second, adjacent side segment which allows rotational movement of the second side segment relative to the support bracket with more than one degree of freedom when the distal end portion of the second side segment is in the released position to selectively permit rotational movement of the distal end portions of the side segments in at least two of up and down displacement movement, axial rotational movement, and side to side swivel movement when the play-yard is being folded.

13. The frame structure according to claim 12, wherein the wall portions of the at least one support bracket form a receptacle for receiving the distal end portions of the respective support member in rotational engagement in the released position.

14. The frame structure according to claim 12, wherein the wall portions of the support brackets and the distal end portions of the side segments each has openings in substantial alignment and an elongated fastener passing through the openings for securing the side segments to the support bracket, the openings and elongated fastener together comprising the rotational coupling, the openings of the wall portions being slightly larger in dimensions than the size of the elongated fastener to permit rotational movement of the distal end portions with at least two degrees of freedom when the play-yard is being folded.

15. The frame structure according to claim 14, wherein the elongated fasteners securing the pair of side segments onto the support bracket form an angle β of between approximately 30° to 75°.

16. The frame structure according to claim 14, wherein the wall openings are elliptical or kidney shape.

17. A foldable children's play-yard frame structure deployable in an open configuration and retractable in a folded configuration, the play-yard comprising:

a plurality of support members, each having a lower portion and an upper portion;

a plurality of support brackets, each support bracket rotatably engaged with the upper portion of a respective support member;

an upper frame member, comprising a plurality of side segments defining the upper perimeter of the play-yard, each side segment comprising at least a pair of rail members coupled in a rotatable relationship and disposed between the upper end portions of a respective pair of adjacent support members, each side segment further having opposite distal end portions movable between an engaged position in engagement with the support brackets at the upper end portions of the adjacent support members to affix the side segment when the play-yard is in the open configuration and a released position when the play-yard is being folded;

a rotational coupling between each side segment distal end portion and the respective support bracket which permits rotational movement of the side segment when the distal end portion is in the released position and the play-yard is being folded;

a base frame member, comprising a base hub and a plurality of extension members hingedly coupled to the base hub and extending therefrom to engage the lower portions of the support members in a pivotal relationship; and each support bracket having a first pivot connection to the upper end portion of the respective support member which allows rotation of the support bracket about the longitudinal axis of the support member, a first rotational coupling on one side of the pivot connection between the support bracket and the distal end portion of a first side segment which allows rotational movement of the first side segment relative to the support bracket when the distal end portion is in the released position, and a second rotational coupling on the other side of the pivot receptacle between the support bracket and the distal end portion of a second, adjacent side segment which allows rotational movement of the second side segment relative to the support bracket when the distal end portion of the second side segment is in the released position.

* * * * *